United States Patent [19]

Schneiter et al.

[11] 4,380,310

[45] Apr. 19, 1983

[54] FLEXIBLE CONTAINER WITH DISPLACEABLE FITTING AND PROBE COUPLER APPARATUS

[75] Inventors: John W. Schneiter, Arlington Heights; Ronald J. Reiss, Hoffman Estates; Albert G. Enskat, Barrington, all of Ill.

[73] Assignee: Container Technologies, Inc., Barrington, Ill.

[21] Appl. No.: 337,392

[22] Filed: Jan. 6, 1982

Related U.S. Application Data

[63] Continuation-in-part of Ser. No. 285,937, Jul. 23, 1981, which is a continuation of Ser. No. 142,154, Apr. 21, 1980, abandoned.

[51] Int. Cl.[3] ..... B65D 25/44

[52] U.S. Cl. ..... 222/501; 222/525

[58] Field of Search ..... 222/105, 519, 520, 522, 222/525, 464, 523, 501, 505, 507, 563, 509, 402.14, 402.24

[56] References Cited

U.S. PATENT DOCUMENTS

| | | | |
|---|---|---|---|
| 710,631 | 10/1882 | Tietz | 137/325 |
| 864,740 | 8/1907 | Hildenbrand . | |
| 2,149,659 | 3/1939 | Bettis | 137/68 |
| 2,717,720 | 9/1955 | Nissen | 222/82 |
| 2,814,418 | 11/1957 | Rieke | 222/91 |
| 3,201,148 | 8/1965 | Shurtleff | 285/3 |
| 3,391,951 | 7/1968 | Miller | 285/3 |
| 3,586,068 | 6/1971 | Nicholson | 222/501 X |
| 3,595,445 | 7/1971 | Buford | 222/213 |
| 3,647,122 | 3/1972 | Nigro | 222/501 |
| 3,930,286 | 1/1976 | McGowen | 222/83 |
| 4,010,786 | 3/1977 | Aguettant et al. | 150/8 |
| 4,022,258 | 5/1977 | Steidley | 141/330 |
| 4,137,930 | 2/1979 | Scholle | 137/68 R |

*Primary Examiner*—Stanley H. Tollberg
*Attorney, Agent, or Firm*—McCaleb, Lucas & Brugman

[57] ABSTRACT

A connector apparatus for use with various types of disposable flexible foodstuff containers, such as polymeric bags containing soft drink syrups, of the type having a fitment attached to a wall of the container. The novel fitment includes a displaceable valve means having a seal plug member slidably received within a passageway and capable of being releasably retained at a pre-fill position and lockably retained at a post-fill position. A mating probe connector is permanently attached to the food product delivery hose system and includes an inner cap and sleeve comprising a probe adapter capable of being detachably secured to the novel fitment and a probe member for engaging the seal plug member. Product drain and positive evacuation structures are provided to assure substantially complete draining of product from the container during use. The probe is movable in response to rotation of a screw-threaded outer cap member.

15 Claims, 7 Drawing Figures

FLEXIBLE CONTAINER WITH DISPLACEABLE FITTING AND PROBE COUPLER APPARATUS

DESCRIPTION OF THE INVENTION

This application is a continuation-in-part of Ser. No. 285,937 filed July 23, 1981 which is a continuation of Ser. No. 142,154 filed Apr. 21, 1980 and is now abandoned.

FIELD OF THE INVENTION

This invention relates to container evacuation systems, and more particularly to a probe type of connector apparatus for use with flexible polymeric bag-type containers.

DESCRIPTION OF THE PRIOR ART

There has been an ever growing need for an inexpensive delivery system by which successive disposable containers of liquid food product can be connected to a delivery hose system and evacuated. The need for such a system has been greatest in the soft drink syrup industry, such as by fast food operators, bars, restaurants, and the like. In the past, soft drink bottlers have provided syrup to their customers in pressurized containers, typically in the form of metallic and plastic canisters. Such pressurized containers were then connected to the customer's liquid dispensing system. The liquid contents were then forced out of the containers and into the delivery tube system by a pressurized gas, typically carbon dioxide.

Such prior art soft drink canisters, and the associated pressurized delivery system, had numerous disadvantages. One problem is that because these prior art canisters were typically formed from stainless steel, there were continual deterioration problems due to the fact that the highly corrosive syrup concentrations were in direct contact with the canisters' stainless steel walls.

Another problem with such prior art pressurized canisters is that certain minimum pressure levels for the gas, such as carbon dioxide, are necessary to adequately force the soft drink product from the canister through the delivery tube system to the point of ultimate use. With certain diet soft drink syrups in which carbon dioxide is highly miscible, there oftentimes results in too much gas being entrained in the syrup due to the high gas pressure levels that are present. This results in poor taste characteristics for the finished soft drink product. Also, these pressurized canisters are oftentimes not entirely emptied in use, resulting in a continuous problem of residual product being left in the canisters and wasted. Further, use of such canisters is relatively expensive in that there are both high initial purchase costs involved as well as high transportation costs encountered in supplying canisters to the customer and returning them to the bottler. A more recent detrimental cost factor concerning such pressurized containers is the fact that the Federal Government has issued proposed guidelines under the Occupational Safety and Health Act which apparently labels them as "pressurized vessels," and as such, may require them to be annually inspected for safety reasons.

Thus, the ability to use disposable flexible polymeric containers with liquid food product delivery systems has become important. However, up until the present invention, there have not been many satisfactory methods by which flexible bag containers could be effectively and inexpensively connected to a liquid product delivery system. (See. U.S. Pat. No. 4,137,930 for one known prior art method.)

SUMMARY OF THE INVENTION

These and other prior art problems have been overcome by the present invention. It provides a novel coupler apparatus having a displaceable seal plug type of fitment and a probe connector apparatus for use with flexible containers, such as foodstuff bags made of polymeric materials, and with associated liquid product delivery systems. This novel coupler apparatus utilizes both reusable components and disposable components. The disposable components include the flexible bag within which the product is contained and transported, a pouring nozzel or so-called fitment joined to the bag, and a cylindrical-shaped displaceable seal plug member which is slidably received within a passageway formed in the fitment. The reusable components are in the form of a probe connector permanently affixed at the connection end of the product delivery tube for a soft drink dispensing system. This reusable connector includes a probe member, a cylindrical sleeve and cylindrical inner cap comprising a probe adapter within which the probe is slidably retained and which is operable to detachably connect the probe connector to the fitment, and an outer cylindrical cap which is operable to move the probe member between opened and closed positions at the receiving end of the delivery tube, the outer cylindrical cap further being operable to move the seal plug member to open position with respect to the bag while opening the probe member with respect to the delivery tube.

In use, the probe connector unit (with the probe member in its retracted position) is threadedly connected to the fitment of a flexible polymeric bag filled with soft drink syrup, for example. Once properly connected, the probe member is forced into the fitment by rotating the outer cylindrical cap thereby engaging and displacing the fitment's seal plug member farther into the fitment's passageway. This in turn exposes product drain means within both the seal plug member and probe member thereby allowing food product to flow from the bag into the delivery tube and on into the dispensing system. The liquid product can be delivered either by gravity flow or under the positive pressure of an associated pump.

It is therefore a primary object of the present invention to provide a probe type of coupler apparatus for use with flexible food bags that are to be connected to liquid delivery systems, and which includes both reusable components as well as inexpensive disposable components.

It is another object of the present invention to provide a fitment for a flexible foodstuff container which uses a displaceable seal plug and foil film seal to provide a tamper-proof product seal.

It is yet another object to provide a fitment for a flexible polymeric container which has a displaceable seal plug member for eliminating the majority of the product from the fitment area thereby tending to reduce the overall oxygen transmission into the food product.

It is a further object of the present invention to provide a probe type of coupler apparatus for soft drink syrup delivery systems having both leak-proof engagement to and dripless engagement from the fitment of a flexible container.

It is a still further object to provide a probe type of coupler apparatus for a liquid dispensing system for a flexible foodstuff container whereby the probe is prohibited from inadvertently piercing a wall of the flexible container.

It is yet a further object to provide a seal plug member for the fitment of a flexible foodstuff container which can not be inadvertently displaced into the interior of the container.

The means by which the foregoing and other objects of the present invention are accomplished and the manner of their accomplishment will be readily understood from the following specification upon reference to the accompanying drawings, in which.

DESCRIPTION OF THE PREFERRED EMBODIMENT

Figure 3:
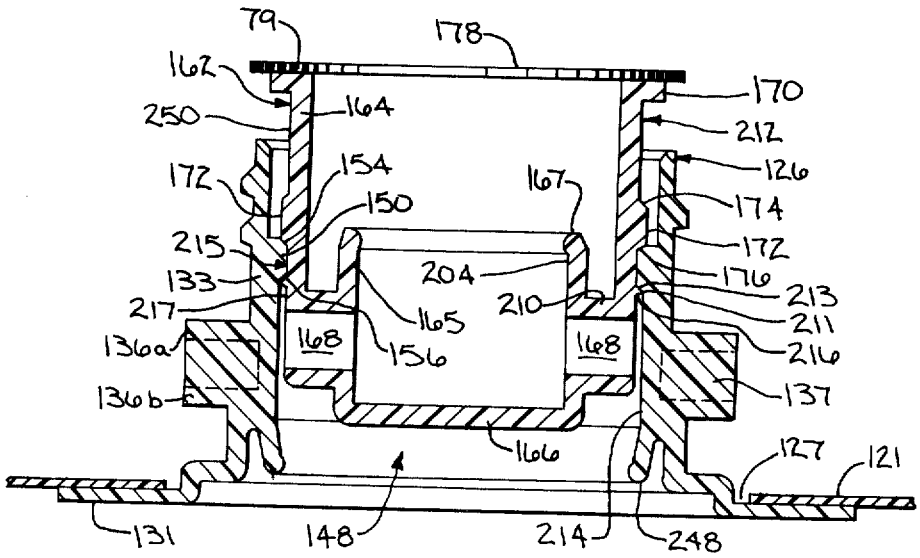
FIG. 3 is a sectional elevation view of a flexible food bag fitted with the aforesaid closure fitment and seal plug members shown in a pre-fill position.

Having reference to the drawings, wherein like reference numerals indicate corresponding elements, there is shown in FIG. 3 an illustration of a flexible polymeric food container bag 121. While not forming a part of the present invention, the bag is of the type having walls formed of multi-layered polymeric film (not shown) which typically are thermally bonded at their edges. (See U.S. Pat. Nos. 3,090,526; 3,556,816; and 4,085,244 for a detailed description of such flexible foodstuff containers.)

Figure 1:
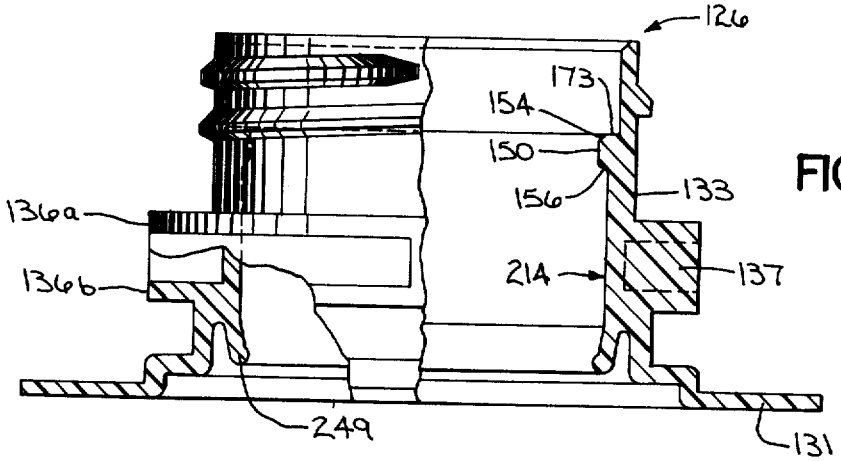
FIG. 1 is a partially fragmented elevation view of a form of closure fitment member usable with the present invention.

A pouring nozzle of so-called closure fitment 126, best shown in FIG. 1, is inserted through an opening 127 formed in bag 121. The fitment includes a base flange portion 131 and a hollow cylindrical spout wall portion 133. The top side of base flange 131 is thermally bonded to the inner surface of the bag wall around opening 127. On the outside of the cylindrical spout wall portion 133 are formed a pair of axially spaced support rings **136*a* and 136*b* which are strengthened at 90° intervals by interposed radial ribs 137. When evacuating the bag 121, the wall 142 of a cardboard carton may be interposed between the base flange portion 131 and the lower support ring 136*b* (see FIGS. 5, 6 and 7). Additionally, during filling of bag 121, the lower ring 131*b* may support the fitment 126 between suitable yoke fingers such as are those designated 44 in FIG. 2** of parent application Ser. No. 285,937.

As seen in FIG. 1, spout portion 133 has an inner annular rib 150. The upper and lower diagonal end surfaces of rib 150 respectively provide a stop shoulder 154 and a lock step shoulder 156, the purpose of both of which will be explained later.

Figure 2:
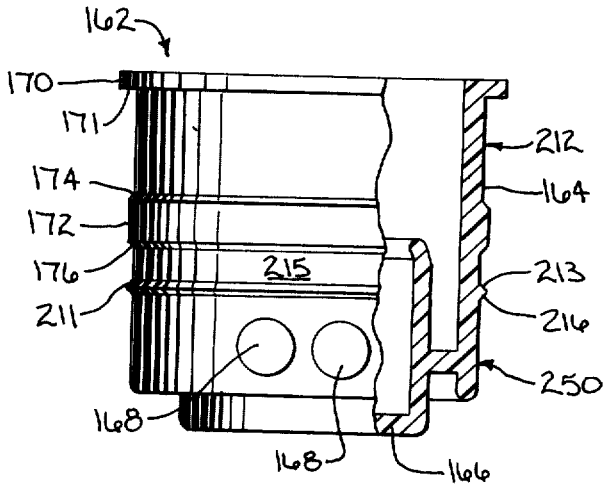
FIG. 2 is a form of seal plug member for use within the fitment shown in FIG. 1.

As shown in FIGS. 2 and 3, a seal plug member 162 has an upwardly open tubular body portion 164. An external cylindrical surface 250 is sealed by wiper ring portion 248 at the bottom of fitment wall 133. An upwardly open, coaxial inner tubular wall 165 is closed at the bottom by a cap portion 166. The top end surface 167 of wall 165 is engageable with the bottom surface 200 of a sleeve 202 as will be described. The inner cylindrical surface 204 of inner tubular wall 165 receives O-rings 206 and 208 as will be described. First drain means in the form of a plurality of drain holes 168 are formed through the annular portion 210. At the upper end of the tubular wall 164 an external flange 170 serves as a stop ring member. Seal plug member tubular wall 164 has an outer annular rib 172. Upper and lower diagonal end surfaces of rib 172 respectively provide a stop shoulder 174 and a lock step shoulder 176. Spaced below the rib 172 is a minor outer annular rib 211 having adjacent upper and lower diagonal end surfaces 213 and 216. The outer diameter 212 of tubular body portion 164 is appreciably smaller than the inner diameter 214 of spout portion 133 so the seal plug member 162 can move relatively freely within the closure fitment 126 except where movement is constrained by interference between the rib 150 and ribs 172 and 211. Groove 215 between ribs 172 and 211 is substantially the same size and shape as rib 150; thus, in the position of FIG. 3, rib 150 seals groove 215 and prevents entrance of outside contaminants into the bag through the clearance space 217. A cap liner 178 formed of pressure-adherent metal foil is placed across the open end of seal plug 162 to seal it temporarily.

Seal plug member 162 is insertable different depths, to different operative positions, in cylindrical spout portion 133 as follows:

(a) rib 150 sits in groove 215 in the pre-fill position of FIG. 3:

(b) rib 172 is immediately below rib 150, with lock step shoulder 156 engaging stop shoulder 174, as shown in the intermediate, tamperproof position of FIG. 4; and (c) ribs 172 and 211 engage the lower portion of spout portion wall surface 214 in the final drain position shown in FIG. 7.

Figure 7:
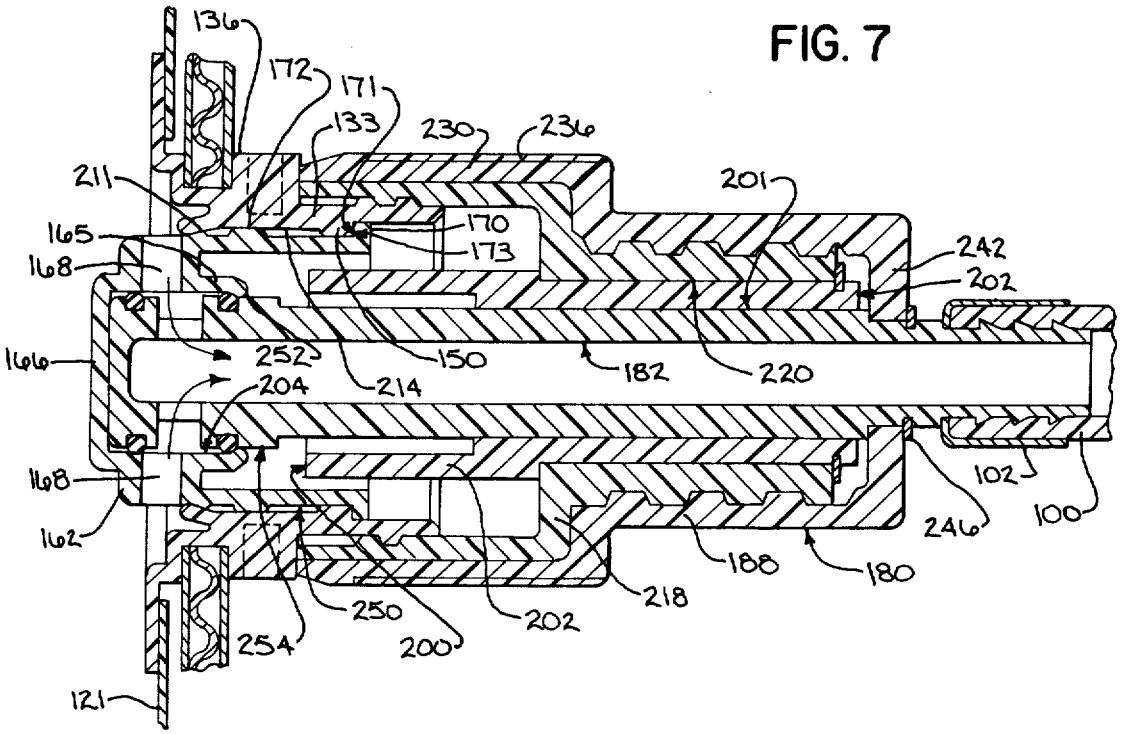
FIG. 7 is a view similar to FIG. 6 with the parts shown in valve open, final drain position.

Movement of seal plug member 162 into the bag 121 is limited by engagement of flange 170 with spout portion stop surface 173 (FIG. 7).

Figures 4, 5:
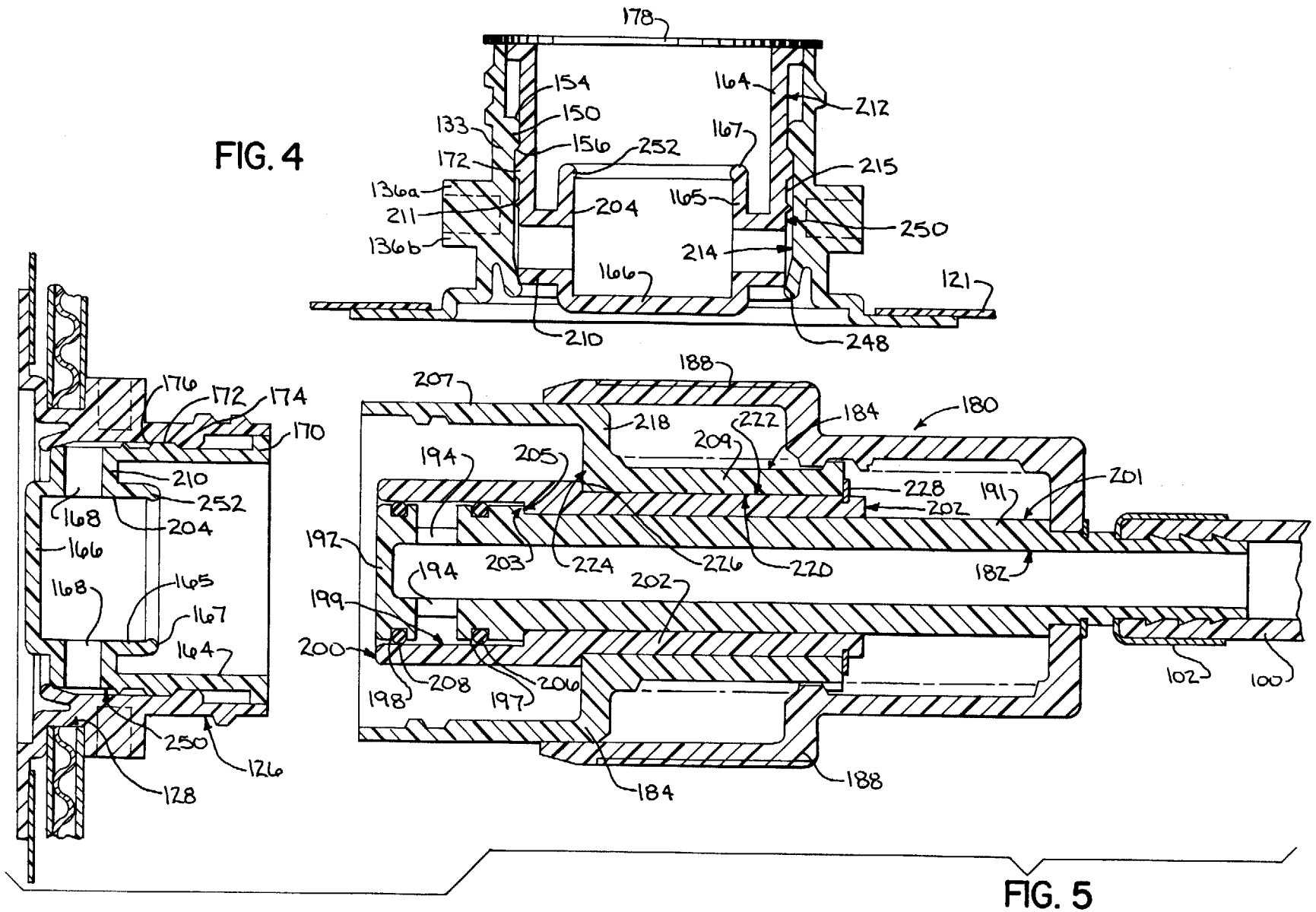
FIG. 4 is a view similar to FIG. 3 showing the members in an intermediate, tamper-proof, post-fill position.
FIG. 5 is a sectional elevation view with the probe connector in back-seated position and separated from the closure fitment member.
Figure 6:
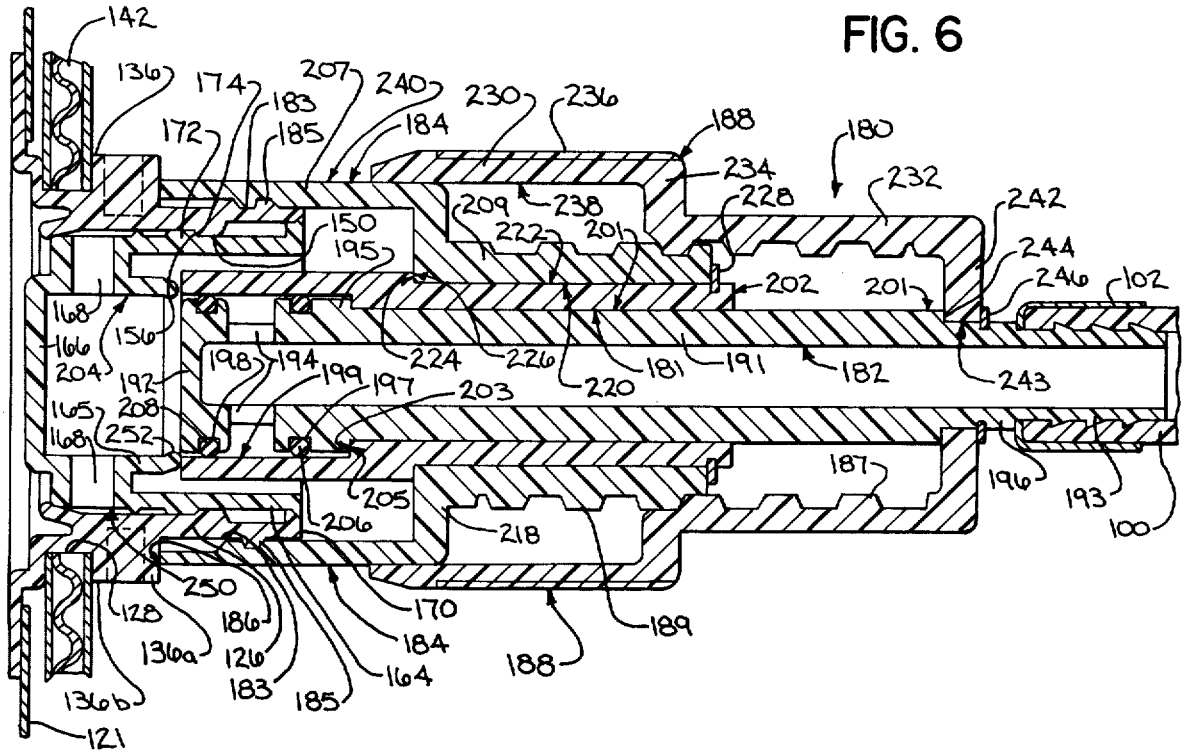
FIG. 6 is a view similar to FIG. 5 showing the probe connector in an intermediate connected position.

FIGS. 5, 6 and 7 show a probe connector device generally designated 180. This comprises a probe member 182, a sleeve 202, an inner cap 184 and a manually rotatable outer cap 188. As will be seen, the sleeve 202 and inner cap 184 are made in two separate pieces for manufacturing and assembly convenience, but function as one piece to assemble the probe member 182 centrally within the fitment 126.

Probe member 182 comprises a hollow tubular body portion 191 having a cylindrical head section 195 at one end. An end wall 192 closes the head section. There is a reduced diameter section 196 and a nipple 193 at the opposite end. A product delivery tube 100 is compressed onto the nipple by a ferrule 102. Additionally, the head section 195 has a second drain means, namely, a plurality of flow or drain holes 194 adjacent the closed end wall 192. O-rings 206 and 208 are seated in grooves 197 and 198 flanking the holes 194. In the final drain position of FIG. 7, the O-rings seal against the inner cylindrical wall 204 of inner tubular wall 165 on opposite sides of drain holes 168. Also, in the FIG. 7 position, a reduced diameter wiper ring portion 252 at the top of tubular wall 165 seals against the outer cylindrical wall 254 on head section 195. In the FIGS. 5 and 6 positions, these O-rings seal against the internal cylindrical wall surface 199 of sleeve 202.

The sleeve 202 has a reduced diameter, cylindrical wall surface 181 slidably engaging the outer cylindrical surface 201 of probe member 182. An internal shoulder 203 on the sleeve engages an external shoulder 205 on the probe member in the FIGS. 5 and 6 positions.

Inner cap member 184 is bell-shaped, having large and small diameter tubular sections 207 and 209 respectively, joined by an annular section 218. Section 209 has an inner cylindrical wall surface 220 closely fitted to an outer cylindrical wall surface 222 of the sleeve.

Inner cap member 184 is fastened to sleeve member 202 for simultaneous longitudinal movement along probe member outer surface 201 as follows: Internal shoulder 224 at the left end of section 209 engages an external shoulder 226 on sleeve 202. At the opposite end, a retaining ring 228 seated in a groove in the sleeve engages the end of section 209. Thus, between shoulder 226 and retaining ring 228, inner cap 184 and sleeve 202 are held against relative movement and function for all practical purposes as a unit.

Coarse Acme screw threads 183 and 185 connect inner cap 184 and sleeve 202 with fitment 126.

Outer cap member 188 is bell-shaped, generally similar to the inner cap member 184 except larger. It has large and small diameter tubular sections 230 and 232 respectively, joined by an annular section 234. Section 230 is knurled as at 236 to facilitate rotating it manually. The inner wall 238 is smooth, cylindrical and slightly larger in diameter to move freely relative to the outer cylindrical surface 240 of inner cup member section 207. Section 232 has a central opening 244 in an end wall 242 within which probe member section 196 is rotatably journaled. Relative axial movement between members 188 and 182 is limited by shoulder 244 and retaining ring 246.

Coarse Acme threads 187 and 189 threadedly connect inner and outer cap members 184 and 188. Thus, manual rotation of member 188 moves probe member 182 axially from the intermediate tamper-proof position shown in FIG. 4 to the fully opened final drain position shown in FIG. 7, and then back again to the back-seated position shown in FIG. 5 after bag 121 is emptied.

Step-by-step use and operation will now be described.

Step 1. Heat seal fitment 126 into the bag 121 and temporarily insert the seal plug member 162 in the spout portion 133, in the pre-fill position of FIG. 3. Foil 178 temporarily closes the open end of the seal plug member 162.

Step 2. Prior to filling, remove seal plug member 162.

Step 3. Mount the fitment 126 and bag 121 in any suitable support, for example, between fingers 44 of the fill support stand 46 shown in FIG. 2 of the patent application Ser. No. 285,937. Fill the bag.

Step 4. Push seal plug member 162 into fitment 126 until their outer ends are flush. This is to the intermediate, tamper-proof, "post-fill" position of FIG. 4. In this position, the external annular rib 172 on the seal plug member has been forced inwardly past the inner annular rib 150 of the fitment spout portion 133. Stop shoulder 174 is retained beneath the lock step shoulder 156. The seal plug member cannot now be removed. Foil 178 is still in place.

Step 5. Place the filled bag 121 in a carton having walls 142 (FIG. 6) and ship it to a restaurant, bar, or other use point.

Step 6. At the use point, extend the fitment through a hole 128 in the carton and remove the foil seal 178. This position is shown at the left hand portion of FIG. 5 where the end cap portion 166 of seal plug member 126 is not yet fully extended into the bag 121. Further, the reusable probe connector 180 is in its back-seated position shown at the right hand portion of FIG. 5, still separated from the fitment 126. Any liquid remaining in probe member 182 and discharge tube 100 will be retained by O-rings 206 and 208.

Step 7. Connect threads 183 of inner cap 184 to threads 185 of fitment 126. Rotate inner cap 184 until its end surface 186 is firmly, frictionally engaged with support ring 136*a* at the position shown in FIG. 6.

Step 8. Grasp the knurled surface 236 of outer cap 188 and rotate it in a tightening direction. Cap 188 rotates and moves downwardly over the tubular section 207. This in turn moves the probe member 182 downwardly to the position shown in FIG. 7 with bottom end cap portion 166 and inlet ports 168 extended into the bag. Fluid can then drain from the bag to the delivery tube via holes 168 and 194, and probe member 182.

Step 9. After the bag is emptied, rotate outer cap 188 in a loosening direction, upwardly to the FIG. 6 position. This is the "back-seated" (sealed) position referred to above in which liquid is positively retained within the probe 182.

Step 10. Rotate inner cap 184 in a loosening direction, releasing the frictional engagement of its end surface 186 with the support ring 136*a*. Disconnect the reusable probe connector assembly 180 to the position shown in FIG. 5. Discard the empty bag and carton, fitment 126 and seal plug 162 and repeat this procedure with a new, filled bag 121.

An important feature of the invention is the power screw assist provided by the threads 187 and 189 in moving the probe member 182 positively inwardly and outwardly between operative positions. Once bag 121 has been emptied, the probe member 182 can be back-seated into the sleeve 202 to positively close off the drain holes 194. Then, inner cap 184 can be unscrewed and the probe connector 180 disconnected for reuse. When the connector 180 is disconnected, as shown in FIG. 5, O-rings 206 and 208 are completely recessed within the end of the sleeve and protected from rough handling. As a further protection against abuse, the end 200 of the sleeve is itself recessed within the section 207 of the inner cap in the FIG. 5 position.

From the foregoing, it is believed that those skilled in the art will readily appreciate the unique features and advantages of the present invention over previous types of fitments and couplers for flexible foodstuff bags. Further, it is to be understood that while the present invention has been described and illustrated with a particular preferred embodiment, as set forth in the accompanying drawings and as above described, the same nevertheless is susceptible to change, variation and substitution of equivalents without departing from the spirt and scope of this invention which should not be restricted by the foregoing description and drawings except as may appear in the following appended claims.

The embodiments of the invention in which an exclusive property or privilege is claimed are defined as follows:

1. The combination of a closure fitment, a seal plug, and a probe connector for use with a disposable container;

said closure fitment comprising a hollow body having a portion attachable to a wall of the container and having a passageway providing communication between the exterior and the interior of the container;

said seal plug preventing external contaminants from entering the container and controlling flow of fluid from the container through a first aperture means, said seal plug comprising a body which is movable within said fitment between positions to open and close said first aperture means;

said probe connector providing means for connecting said closure fitment to a delivery tube for conveying fluid from said container to a point of use; said probe connector comprising probe means, probe adapter means, and a second aperture means; said probe adapter means being detachably connectible to said closure fitment to place said second aperture means in communication with said first aperture means; said probe means having a tubular body slidably journaled in said adapter means for axial movement between positions to open and close said second aperture means;

a manually rotatable probe actuating member connected to said probe means and threadedly engaged with said adapter means to move said probe means in an axial direction in response to rotation of said probe actuating member relative to said adapter means;

whereby forward flow of fluid is enabled from the container to the point of use by opening the first and second aperture means when the probe connector is connected to the closure fitment; and whereby further, back flow of fluid from the delivery tube is prevented by closing the second aperture means when the probe connector is disconnected from the closure fitment.

2. The combination of claim 1 in which the probe adapter means is connectible to the closure fitment by screw thread means.

3. The combination of claim 1 in which the probe adapter means comprises: a cylindrical sleeve member within which the tubular body of the probe means is slidably journaled; and another member fastened thereto having a cylindrical section with a screw-threaded connection to the closure fitment.

4. The combination of claim 1 in which the probe adapter means comprises: a cylindrical sleeve member within which the tubular member of the probe means is slidably journaled; and another member fastened thereto having a cylindrical section with a screw threaded connection to the manually rotatable probe actuating member.

5. The combination of claim 1 in which said seal plug has a tubular section with an outer cylindrical wall axially movable within an inner cylindrical wall of said closure fitment, and detent means is provided between said cylindrical walls enabling separate degrees of insertion of the seal plug within the closure fitment as follows:

a pre-fill position in which the seal plug is relatively lightly retained and can readily be withdrawn for filling the container;

an intermediate tamperproof position beyond the pre-fill position from which the seal plug cannot be withdrawn without noticeable damage to the detent means; and a final drain position beyond the intermediate tamperproof position in which the first aperture means is open.

6. The combination of claim 5 in which said detent means comprises a first rib of one axial length on one of said cylindrical walls, the other of said cylindrical walls having a pair of ribs spaced apart axially a distance to provide a groove therebetween within which said first rib can fit when the seal plug is in said pre-fill position, the lower one of said pair of ribs being so dimensioned and positioned to provide only minor resistance to removal of the seal plug from said pre-fill position, but the other of said pair of ribs being below said one rib in said intermediate tamperproof position and being dimensioned and positioned to provide major resistance to removal of the seal plug from said tamperproof position.

7. The combination of claim 5 in which the upper end of said seal plug extends above said closure fitment in said pre-fill position to facilitate removal for a filling operation, and in which the upper end of said seal plug is substantially flush with the end of said closure fitment in said intermediate tamperproof position to make the seal plug difficult to remove.

8. The combination of claim 5 in which said first aperture means is in one of said cylindrical walls and is uncovered in said final drain position.

9. The combination of claim 1 in which the seal plug has an external cylindrical wall surface sealingly engageable by a wiper ring at the bottom of said closure fitment, said first aperture means extends through said cylindrical wall in the seal plug and is displaced beyond said wiper ring into communication with the interior of the container when the seal plug is moved to open said first aperture means.

10. The combination of claim 3 in which the probe means tubular body includes a head section with an external cylindrical wall in slidable engagement with an internal cylindrical wall in said sleeve member, said second aperture means extends through said external cylindrical wall and said head section has a pair of O-ring seals disposed in grooves flanking said second aperture means.

11. The combination of claim 10 in which the seal plug has an internal cylindrical wall axially aligned with the internal cylindrical wall in the sleeve member, both of said internal cylindrical walls being of substantially the same diameter, said cylindrical wall in the seal plug being of sufficient axial length to receive at least that part of the head section having said O-ring seals and having a wiper ring at its upper end sealingly engageable with said external cylindrical wall on said head section.

12. The combination of claim 11 in which said sleeve member is engageable with the seal plug to move the latter into a bottomed position where the first and second aperture means are in open position.

13. The combination of claim 5 in which the seal plug has a stop flange engageable with the closure fitment in the final drain position to prevent further movement of the seal plug beyond said final drain position.

14. The combination of claim 1 in which the manually rotatable probe actuating member is connected to the probe means through a rotatably journaled connection.

15. The combination of a closure fitment, a seal plug, and a probe connector for use with a disposable container;

said closure fitment comprising a hollow body having a portion attachable to a wall of the container and having a passageway therethrough providing communication between the exterior and interior of the container;

said seal plug comprising a body which is movable within said fitment to an opened position;

first aperture means acting between said closure fitment and said seal plug and being effective when said seal plug is moved to said opened position to provide communication between the interior of the container and the interior of the seal plug;

said probe connector comprising probe means, probe adapter means and manually rotatable probe actuating means which is separable as a unit from said fitment;

said probe adapter means comprising a body which is detachably connectible to said closure fitment;

said probe means comprising a hollow tubular body having means for connecting to an external delivery tube and being slidably journaled within said probe adapter means and axially movable between opened and closed positions;

second aperture means associated with said probe adapter means, said probe means, and said seal plug, said probe means being effective when moved to its said opened position to provide communication between the interior of said container and the interior of said probe means through said first and second aperture means, said probe means being effective when moved to its said closed position to close said second aperture means to prevent back flow from the delivery tube when the probe connector is disconnected from the closure fitment; and said manually rotatable probe actuating means comprising a tubular body having means connecting it with said probe means and said probe adapter means respectively to move said probe means between its said opened and closed positions in response to rotation thereof.

* * * * *